United States Patent [19]

Mattson

[11] Patent Number: 4,528,544

[45] Date of Patent: Jul. 9, 1985

[54] CONTROL APPARATUS FOR VARIABLE SPEED REVERSIBLE MOTOR

[75] Inventor: Richard W. Mattson, Rossford, Ohio

[73] Assignee: Allied Corporation, Southfield, Mich.

[21] Appl. No.: 530,936

[22] Filed: Sep. 12, 1983

[51] Int. Cl.[3] ..... H01C 10/00

[52] U.S. Cl. ..... 338/78; 338/198; 338/200; 338/215

[58] Field of Search ..... 338/78, 198, 200, 201, 338/215, 128; 200/1 V; 318/295, 300

[56] References Cited

U.S. PATENT DOCUMENTS

| | | | |
|---|---|---|---|
| 519,120 | 5/1894 | Herdman . | |
| 549,593 | 11/1895 | Fiske . | |
| 549,597 | 11/1895 | Fiske | 338/78 |
| 1,242,357 | 10/1917 | Ljungstrom . | |
| 1,450,572 | 4/1923 | Bahls . | |
| 1,474,312 | 11/1923 | Wyman . | |
| 1,890,375 | 12/1932 | Garrett . | |
| 1,934,306 | 11/1933 | Happy | 200/7 |
| 2,617,911 | 11/1952 | Carey et al. | 338/78 |
| 2,637,796 | 5/1953 | Pike, Jr. | 201/48 |
| 2,716,874 | 12/1955 | Wiley | 64/23 |
| 3,303,403 | 2/1967 | Bonanno | 338/198 X |
| 3,310,768 | 3/1967 | Opelenik et al. | 338/198 |
| 3,456,229 | 7/1969 | Matthews | 338/198 |
| 3,465,841 | 12/1969 | Pulskamp et al. | 180/65 |
| 3,668,597 | 6/1972 | Nomura | 338/198 |
| 3,737,830 | 6/1973 | Lark et al. | 338/128 |

*Primary Examiner*—Roy N. Envall, Jr.
*Assistant Examiner*—C. N. Sears
*Attorney, Agent, or Firm*—J. P. DeClercq; R. C. Wells

[57] ABSTRACT

A control unit, adapted to control a reversible, variable-speed electrical motor includes a control lever protruding through a U-shaped slot in a housing. Movement of the lever from one side to the other of the U-shaped slot controls the direction of rotation of the motor, and its position along a side of a slot determines the speed of rotation. The control lever is mounted to a pivotally mounted support member, which carries a linear potentiometer operated by the control lever, and includes a protruding portion which carries a toggle switch. The handle of the toggle switch is substantially restrained from motion, so that the switch is actuated to reverse the motor when the control lever is moved from one side of the U-shaped slot to the other.

6 Claims, 8 Drawing Figures

CONTROL APPARATUS FOR VARIABLE SPEED REVERSIBLE MOTOR

This application relates to the field of electrical controls. In particular, this application relates to an electrical control having a single control element for controlling both a variable resistor and a reversing switch.

BACKGROUND OF THE INVENTION

In machinery for forming metal and wood, some apparatus for reversing the rotational direction of either the workpiece or the tool, and for varying the rotational speed of the workpiece or tool as appropriate for the task to be accomplished. For example, threading operations require a much lower speed than turning or boring operations, and sanding or polishing operations require a yet higher speed. Previously, speed and direction control for such tasks on metalworking machinery was accomplished with a constant-speed unidirectional or reversible motor, together with repositionable drive belts or variable-diameter pulleys, sometimes in combination with interchangeable or shiftable gearing. Also, a separate rotary potentiometer or variable resistor for speed control and a reversing switch for direction control have been provided. As will be apparent, such an arrangement is undesirable, since it permits the unintentional starting of a rotating element at a high rate of speed, and also permits the reversal of rotation at a high rate of speed, resulting in high mechanical stresses and electrical stresses upon reversing switch contacts. In an attempt to prevent reversal of rotation at high speed, special electrical switches, known as hesitation switches, have been provided, which prevent continuous operation from a control switch from a first direction position to a second direction position. Such switches are relatively expensive, and are seldom used.

The instant invention provides a solution to these and other deficiencies of known motor control devices.

SUMMARY OF THE INVENTION

The instant invention provides an apparatus for controlling the speed and direction of rotation of a variable speed reversible motor, and having a single operating lever protruding through and guided by a generally U-shaped slot, having a bight and two sides. When the control lever is positioned at the bight of the generally U-shaped slot, the controlled motor is stopped. As the control lever is moved from the bight of the generally U-shaped slot along a leg of the slot and away from the bight, the motor's speed of rotation increases. Positioning the operating lever in a first leg of the slot produces rotation in a first direction, and positioning the lever in the second leg of the slot produces motor rotation in a second direction. As the control lever is moved from the first leg of the slot to the second leg of the slot, it passes through the bight of the slot, so that the rotation of the motor is substantially stopped before an attempt can be made to reverse its direction of rotation.

As will appear more fully in the detailed description which follows, moving the operating lever in a leg of the slot, towards or away from the bight of the U-shaped slot, it operates a variable resistor. As the operating lever is moved from one leg to the other through the bight of the slot, a reversing switch is operated, to control the direction of rotation of the motor.

Thus, the instant invention provides a control unit for a reversible, variable speed motor, including potentiometer means for controlling the speed of the motor, switch means for reversing the motor, and housing means for mounting the potentiometer and the switch. The housing means includes pivotally mounted support means for mounting the potentiometer and the switch, and restraining means for restraining the operating lever of the switch or the switch body from movement when the support is moved about a pivot to operate the switch. The support means is mounted on the pivot, and includes an actuating lever attached to the potentiometer for operating the potentiometer. The actuating lever extends through a U-shaped slot defined by an exterior surface of the housing, and is moveable in the slot. The U-shaped slot has a bight portion and a first side portion and a second side portion, the potentiometer being operated to control the speed of the motor as the actuating lever is manually moved in the U-shaped slot, and the switch means being operated to a first position when the actuating lever is disposed in a first side portion of the U-shaped slot and operated to a second position when the actuating lever is disposed in the second side portion of the U-shaped slot, to control the direction of the motor.

It is an objective of the invention to provide a control unit having a single control lever for controlling both speed and direction of a variable speed reversible motor. It is a feature of the invention that the manually-actuatable control lever moves in a U-shaped slot, the distance of the control lever from the bight of the slot determining the speed of rotation, and moving the operating lever from one side or leg of the U-shaped slot changes the direction of rotation.

It is a feature of the invention that the controlled motor must be slowed and substantially stopped before it can be reversed.

It is a further advantage of the invention that standard and conventional potentiometers and reversing switches may be used, rendering the invention easy and inexpensive to construct, and easy to repair, should repairs become necessary.

Other objectives, advantages and features of the invention will become apparent from the detailed description which follows.

DETAILED DESCRIPTION OF THE INVENTION

Figure 1:
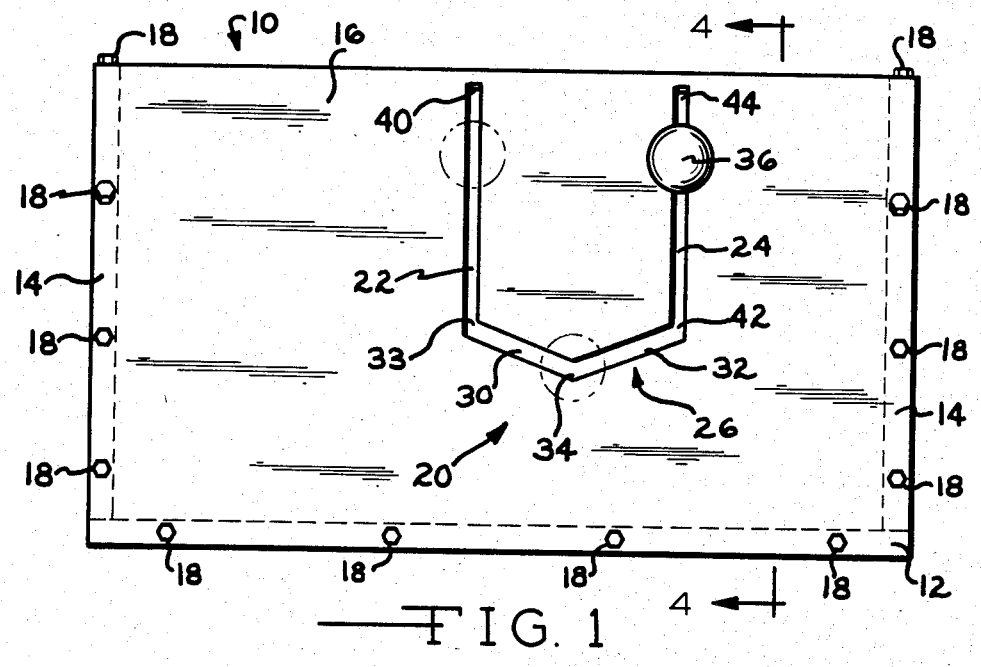
FIG. 1 is a front elevational view of a housing having a generally U-shaped slot according to the preferred embodiment of the invention.

As can be seen from FIG. 1, the instant invention includes a housing 10 having a base plate 12, end plates 14 and a front and top panel member 16. Panel member 16 is fastened to plates 12 and 14, such as by a plurality of screws 18. As shown, panel member 16 defines a generally U-shaped slot 20 having a first side or leg portion 22 and a second side or leg portion 24, interconnected by a bight portion 26. Bight portion 26 is formed of a first bight portion 30 and a second bight portion 32. Portion 30 is joined to portion 22, portion 32 is joined to portion 24, and portions 30 and 32 joined at a lowermost portion 34. A control ball member 36 is shown disposed adjacent second side or leg portion 24, and also in phantom lines adjacent lowermost portion 34 and adjacent first side or leg portion 22. Control ball member 36 is moveable continuously within portions 22, 24, 30, 32, 34. As will become more apparent, when control ball member 36 is disposed adjacent lowermost portion 34 of slot 20, an associated motor will not be energized. When control member 36 is displaced from lowermost portion 34 into portion 30 or 32, an associated motor will preferably be rotating at a rotational rate too low for the motor's intended use. The motor will rotate at a usable rotational rate as ball member 36 is moved between low speed portion 38 and high speed portion 40 of first side or leg portion 22, or between low speed portion 42 and high speed portion 44 of second side or leg portion 24.

Figure 2:
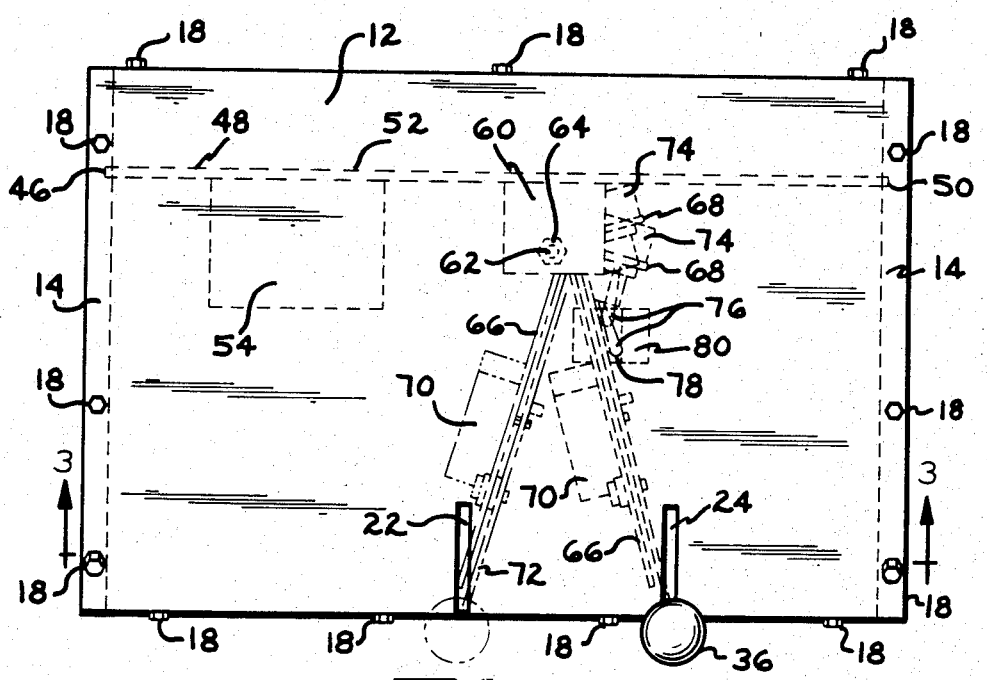
FIG. 2 is a top elevational view of the housing of FIG. 1.

Turning now to FIG. 2, it can be seen that end plates 14 and base plate 12 define aligned grooves 46, 48, 50 for supporting a mounting panel 52. Mounting panel 52 supports a commercially-available motor speed control module 54. If desired, such a module may also be implemented from discrete components using a phase-shift circuit to control the firing times of SCRs in a bridge configuration. Other types of voltage control circuits may also be used.

Figure 3:
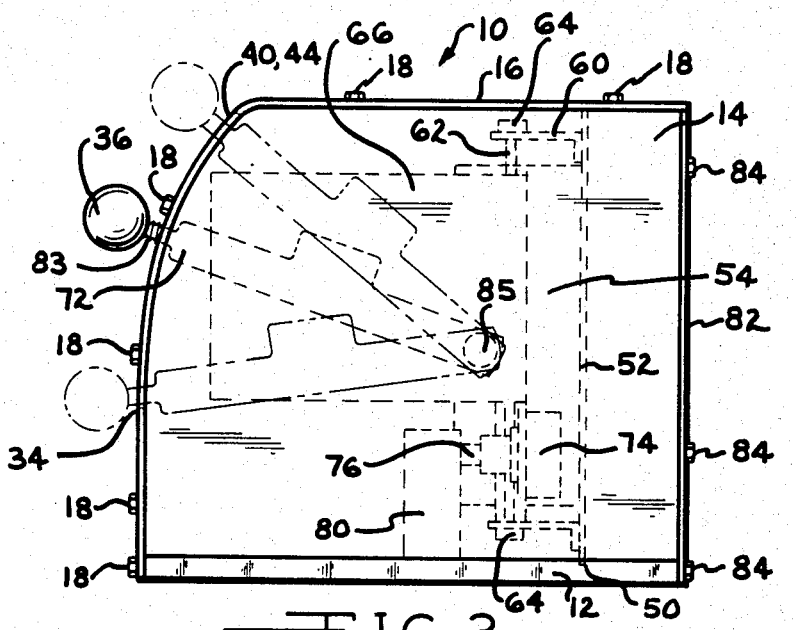
FIG. 3 is an end elevational view of the housing of FIG. 1.

As shown in FIG. 2, an upper support bracket 60 supports a pivot rod 62, which is secured with a nut 64. A support means 66 including a switch support portion 68 is pivotally mounted to pivot rod 62, and pivots as shown about rod 62 as control ball member 36 is moved from first side or leg portion 22 to second side or leg portion 24. A variable resistor, shown as a linear variable resistor 70 is mounted on support means 66. A control or actuating lever 72 is also mounted to support means 66, and carries ball 36 at one end. As will appear more fully below, control or actuating lever 72 operates variable resistor 70 as ball 36 is moved between portion 34 and portion 40 or 42. As will appear in greater detail in the succeeding figures, switch support portion 68 preferably includes a conventional switch such as DPDT switch 74 with a bat handle or operating lever 76 which is received in an aperture 78 in a restraining means 80. Handle 76 serves as the operating lever of switch 74. As will be apparent, other types of switches, with other types of operating levers may also be used. In the instant embodiment, switch 74 directly reverses the armature connections to the controlled motor. A single pole switch could be used to electronically reverse the current to the motor, or a switch provided with additional poles may be used to operate an indicating lamp or the like to indicate the direction of rotation or the polarity of applied voltage. As can be seen in FIG. 3, and in greater detail in FIG. 8, switch 74 will be actuated as control ball member 36 is moved through lowermost portion 34 of U-shaped slot 20.

Turning now to FIG. 3, it can be seen that housing 10 also includes a back panel 82 retained by screws 84 to base plate 12 and end plate 14. Also as shown in FIG. 3, control ball member 36 threadedly engages a threaded end 83 of control lever 72. Control lever 72 is pivotally mounted to support means 66 by a mounting means shown as a rivet 85, and may be positioned with control ball member 36 adjacent high speed portion 40 or 44, adjacent lowermost portion 34, or in an intermediate position as shown.

Figure 4:
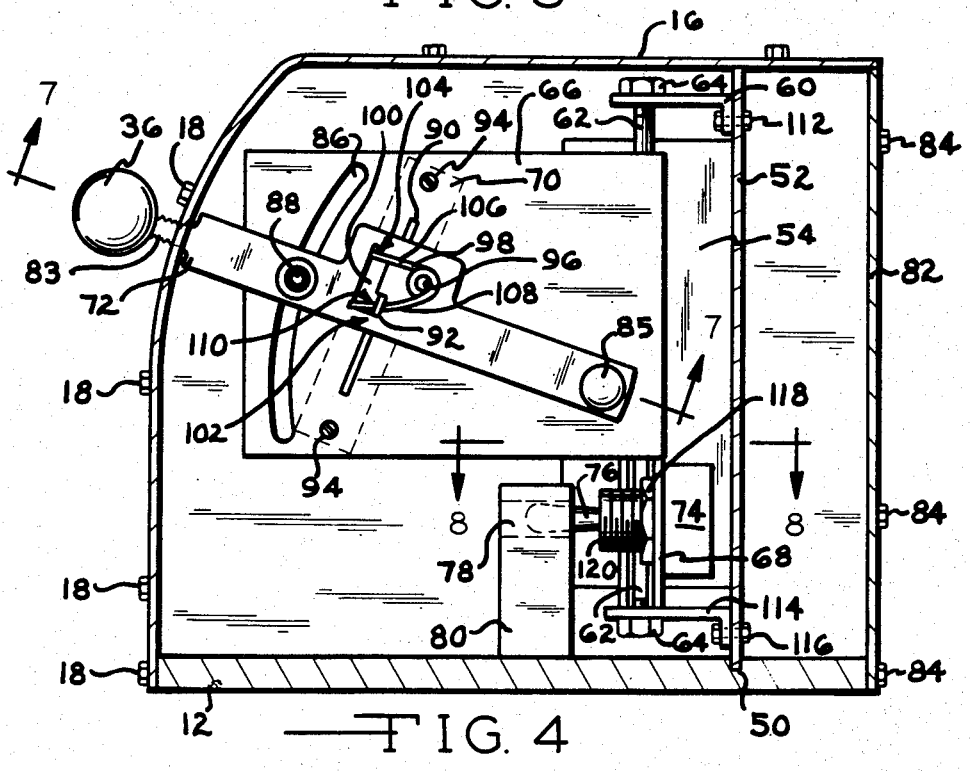
FIG. 4 is a sectional view taken along line 4—4 in FIG. 1.

Turning now to FIG. 4, the structure of the invention is illustrated in greater detail. Support means 66 is shown as including an arcuate guide slot 86 which cooperates with a guide member 88, shown in greater detail in FIG. 7, affixed to control lever 72, to cause support means 66 to move laterally with lateral movements of control ball member 36. Support means 66 also includes a slot 90, for allowing the passage of an actuating member 92 of variable resistor 70 therethrough. Variable resistor 70 is mounted to support means 66 by screws 94. Actuating lever 72 includes a protruding pin member 96, for mounting a torsion spring 98. Control lever 72 further defines an aperture 100, which is shown as generally L-shaped, and has a first portion 102 for retaining actuating lever 92, and a second portion 104 for retaining an end 106 of torsion spring 98. The opposite end 108 of spring 98 passes through an aperture 110 in actuating lever 92, to resiliently urge it against an edge of portion 102 of aperture 100.

It should be specifically noted that, when directions of movement involved in the operation of the subject invention are used herein, they are used for purposes of convenience of description, since the invention itself is not limited to use in any particular position. The illustrated embodiment is adapted for use in the position as shown, but the addition of a single spacer or the like on pivot rod 62 between support means 66 and upper bracket 60 would adapt the invention for use in an inverted position.

It should further be specifically noted that, although switch 74 is shown as moving with support means 66, while its handle 76 is restrained from movement, it is within the scope of the invention to mount the body of a switch in a fixed position and pass its handle through an aperture or the like in portion 68, and that it is also within the scope of the invention to provide switch 74 as a push-button switch or the like, either mounted to portion 68 and being actuated by contact of its push button against a fixed object, or mounted as a fixed object and having its push button actuated by portion 68.

Also, although variable resistor 70 is shown as a linear resistor, it will be apparent that a rotary variable resistor may also be substituted in the invention, such as by its actuating shaft being substituted for rivet 84 in any convenient manner.

Also shown in FIG. 3 are the details of the mounting of support means 66. Upper bracket 60 is generally L-shaped and mounted to mounting panel 52 by fastening means 112. Pivot rod 62 passes through an aperture in upper bracket 60. Similarly, lower bracket 114 is generally L-shaped, and is mounted to mounting panel 52 by fastening means 116, and also receives an end of pivot rod 62 and retains it with a nut 64. As illustrated, rod 62 is threaded at both ends. However, any suitable means for retaining a rod member functionally equivalent to pivot rod 62 may also be used.

Switch 74 is shown mounted to switch support portion 68 by a nut 118 applied to threaded mounting portion 120.

Figure 5:
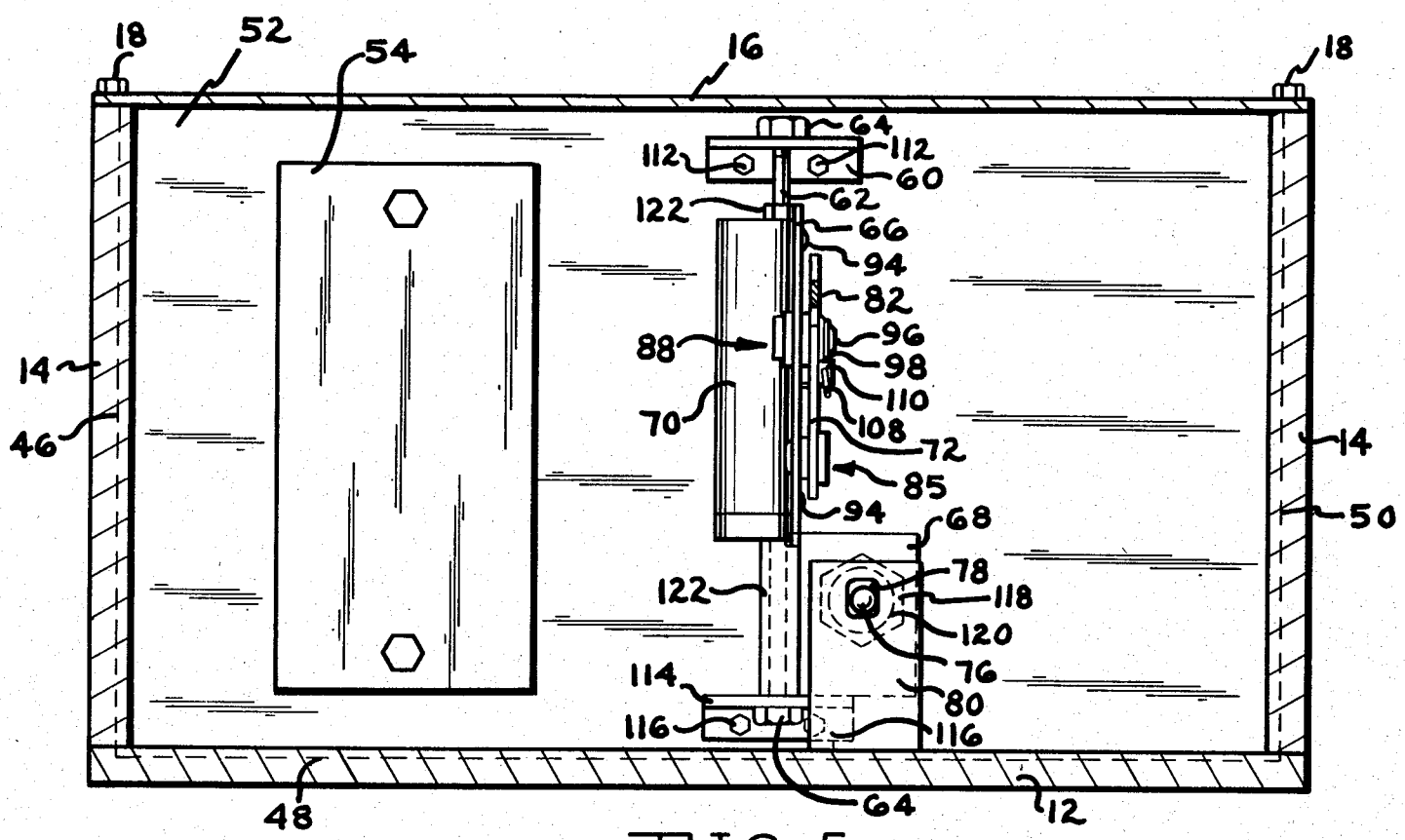
FIG. 5 is a sectional view taken along line 3—3 in FIG. 2.

As may be seen from FIGS. 4 and 5, support means 66 is retained to pivot rod 62 by a rolled-over edge portion 122, which forms a linearly-extending circular aperture adapted to receive pivot rod 62.

Figure 6:
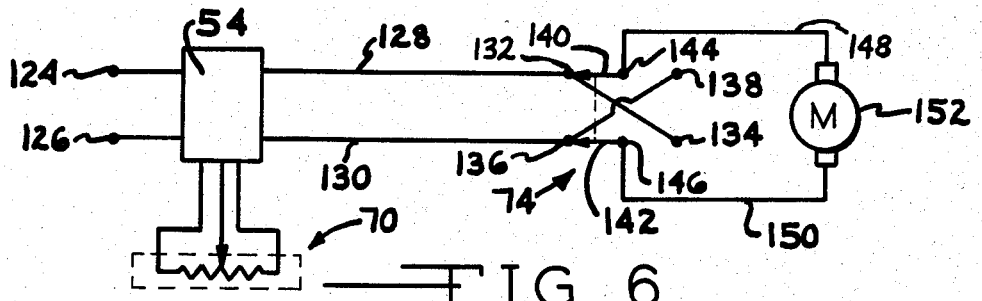
FIG. 6 is a schematic diagram illustrating the electrical interconnection of the invention.

In FIG. 6, a wiring diagram of the invention is shown. As illustrated, motor speed control module 54 is connected to a source of electrical energy, which, in the preferred embodiment of the invention, is alternating current applied to terminals 124, 126, and also connected to variable resistor 70. Motor speed control module 54, in the preferred embodiment of the invention, provides electrical energy in the form of direct current on output lines 128, 130, connected to switch 74 which, as illustrated, is a double pole, double throw switch connected in reversing configuration. As illustrated, line 128 is connected to terminal 132 and 134, and line 130 is connected to terminal 136 and 138. As illustrated, interlinked moving elements or wipers 140 and 142 respectively interconnect terminal 144 with terminal 132 and terminal 146 with 136, thus connecting line 128 to a motor lead 148 and line 130 to a motor lead 150. As is apparent, wipers 140, 142 may be actuated to connect terminal 144 to terminal 138, and to connect terminal 146 to terminal 134. This connects line 130 to motor lead 148 and line 128 to motor lead 150, thus reversing the direction of rotation of motor 152. Motor 152 may be either a permanent-magnet field motor or a wound-field motor, with a field winding, not shown. Thus, actuation of variable resistor 70 varies the voltage appearing between lines 128 and 130, and actuation of switch 74 reverses the direction of motor rotation of motor 152.

Figure 7:
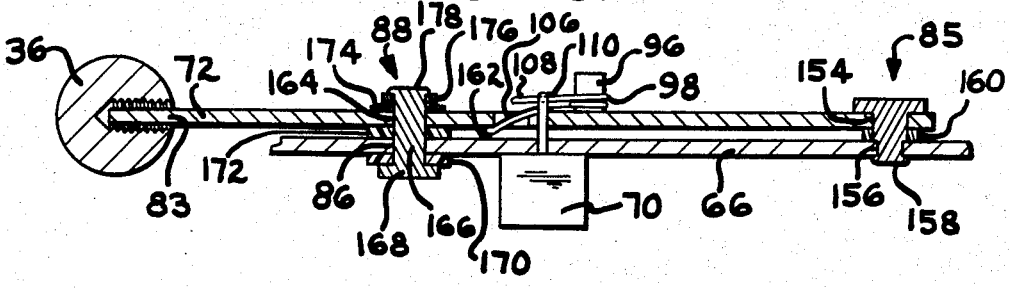
FIG. 7 is a sectional view taken along line 7—7 in FIG. 4.

Turning now to FIG. 7, it can be seen that rivet 85 is a shoulder rivet, passed through an aperture 154 in control lever 72, and an aperture 156 in support means 66 and fastened by heading as shown at 158. A washer 160 is interposed between lever 72 and support means 66 around rivet 84. Also shown is the means of retaining end 106 of spring 98. As shown, it passes through second portion 104 of aperture 100 and has a bent end 162 which engages a surface of arm 72 opposite that of pin member 96.

Guide means 88 is shown as a rivet passing through an aperture 164 in lever 72 and through arcuate guide slot 86 in support means 66. Guide means 88 includes a rivet 166 having a head 168, a washer 170 interposed between head 168 and support means 66, a washer 172 interposed between support means 66 and control lever 72, and a spring washer 174 and flat washer 176. Rivet 166 is headed at end 178 to retain spring washer 174 against control lever 72. Spring washer 174 applies a resilient force, through rivet 166, to maintain control ball member 36 in any desired position within U-shaped slot 20.

Figure 8:
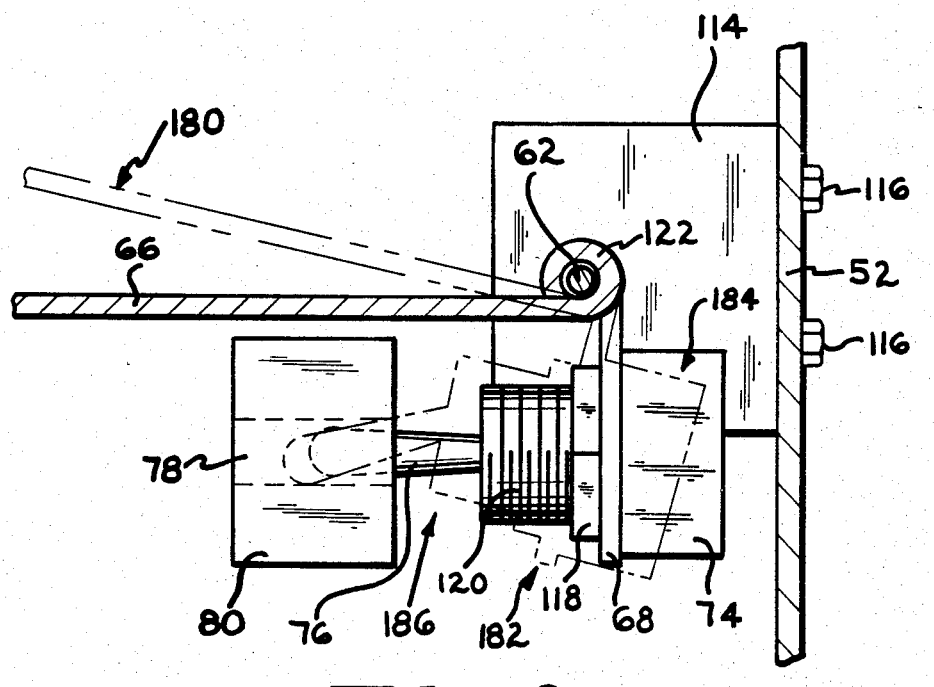
FIG. 8 is a partial sectional view taken along line 8—8 in FIG. 4.

Referring now to FIG. 8, it can be seen that, when control ball member 36 is moved from second side or leg portion 24 of U-shaped slot 20 to first side or leg portion 22, support means 66 moves from the position shown in solid lines to the position shown in phantom lines at 180. Correspondingly switch support portion 68 moves to position shown in phantom lines at 182. Switch 174 thus moves from the position shown in solid lines to the position 184 shown in phantom lines, causing threaded mounting portion 120 of switch 74 to move to the position shown in phantom lines as position 186. Since handle 76 is retained in aperture 78 in restraining means 80, it does not move significantly, and switch 74 is actuated to reverse motor 152. Aperture 78 is long enough so that the axial movement produced by movement of support means 66 to position 180, and vice versa, does not allow handle 76 to escape from aperture 78.

Although described as being useful for the control of a reversible, variable speed motor, applicant does not intend to limit the application of his invention to such a device, since it is believed that there may be numerous other fields of use for his invention.

As will be apparent to one skilled in the art, numerous modifications and variations of the invention, in addition to those recited above, may be easily made, without departing from the spirit and scope of the invention.

I claim:

1. A control unit for an electrical device, comprising:

potentiometer means for controlling the voltage applied to said electrical device;

switch means for reversing the polarity of said voltage;

housing means for mounting said potentiometer means and said switch means;

said housing means including pivotally mounted support means for mounting said potentiometer means and a first portion of said switch means and restraining means for restraining a second portion of said switch means from movement when said support means is moved about a pivot means to operate said switch means;

said support means being mounted on said pivot means;

an actuating lever means attached to said potentiometer means for operating said potentiometer means;

said actuating lever means extending through a U-shaped slot defined by an exterior surface of said housing means and moveable therein;

said U-shaped slot having a bight portion and a first side portion and a second side portion;

said potentiometer means being operated to control said voltage as said actuating lever means is manually moved in said U-shaped slot;

said switch means being operated to a first position when said actuating lever means is disposed in said first side portion of said U-shaped slot and being operated to a second position when said actuating lever means is disposed in said second side portion of said U-shaped slot to control the polarity of said voltage.

2. A control unit according to claim 1, wherein:

said switch means is a double pole, double throw toggle switch.

3. A control unit according to claim 1, wherein:

said potentiometer means is a linear potentiometer.

4. A control unit according to claim 3, wherein:

said actuating lever means is pivotally mounted to said support means and operates a slider member of said linear potentiometer as said actuating lever is moved in said U-shaped slot.

5. A control unit according to claim 3, wherein:

said pivot means is a linearly extending pivot rod disposed parallel to said first side portion and to said second side portion.

6. A control unit according to claim 1, wherein:

said first portion of said switch means is a body portion and said second portion of said switch means is an actuating lever portion.

* * * * *